US007290510B2

(12) United States Patent
Takahashi et al.

(10) Patent No.: US 7,290,510 B2
(45) Date of Patent: Nov. 6, 2007

(54) VALVE TIMING ADJUSTING APPARATUS

(75) Inventors: Kinya Takahashi, Obu (JP); Masayasu Ushida, Okazaki (JP); Takao Nojiri, Anjo (JP); Seiji Yaoko, Anjo (JP); Jun Yamada, Okazaki (JP)

(73) Assignees: Denso Corporation, Kariya, Aichi-pref (JP); Nippon Soken, Inc., Nishio, Aichi-pref (JP)

( * ) Notice: Subject to any disclaimer, the term of this patent is extended or adjusted under 35 U.S.C. 154(b) by 0 days.

(21) Appl. No.: 11/599,396

(22) Filed: Nov. 15, 2006

(65) Prior Publication Data

US 2007/0107684 A1 May 17, 2007

(30) Foreign Application Priority Data

Nov. 15, 2005 (JP) ..... 2005-330135

(51) Int. Cl.
*F01L 1/34* (2006.01)

(52) U.S. Cl. ..... 123/90.15; 123/90.12; 464/160

(58) Field of Classification Search ..... 123/90.15, 123/90.17, 90.16, 90.18, 90.12, 90.13, 90.27, 123/90.31; 464/1, 2, 160
See application file for complete search history.

(56) References Cited

U.S. PATENT DOCUMENTS

| | | | | |
|---|---|---|---|---|
| 5,657,725 | A | 8/1997 | Butterfield et al. | |
| 6,763,791 | B2 | 7/2004 | Gardner et al. | |
| 7,143,729 | B2 * | 12/2006 | Yaoko et al. | 123/90.17 |
| 2005/0284433 | A1 | 12/2005 | Yaoko et al. | |

FOREIGN PATENT DOCUMENTS

| | | |
|---|---|---|
| JP | 2003-343218 | 12/2003 |

* cited by examiner

*Primary Examiner*—Ching Chang
(74) *Attorney, Agent, or Firm*—Nixon & Vanderhye P.C.

(57) ABSTRACT

A valve timing adjusting apparatus has a housing and a vane rotor to form multiple fluid chambers, and a relative position of the vane rotor to the housing is adjusted by the fluid pressure supplied into the fluid chambers. A check valve is provided in a branched passage portion, so that working fluid may not be pushed out from an advancing fluid chamber to a low pressure side, even when the working fluid in the advancing fluid chamber is temporally compressed to increase its fluid pressure due to a torque change applied from a cam shaft to the vane rotor.

9 Claims, 13 Drawing Sheets

VALVE TIMING ADJUSTING APPARATUS

CROSS REFERENCE TO RELATED APPLICATION

This application is based on Japanese Patent Application No. 2005-330135 filed on Nov. 15, 2005, the disclosure of which is incorporated herein by reference.

FIELD OF THE INVENTION

The present invention relates to a valve timing adjusting apparatus, which adjusts a valve opening and closing timing (hereinafter referred to as a valve timing) for at least one of intake and exhaust valves for an internal combustion engine.

BACKGROUND OF THE INVENTION

A valve timing adjusting apparatus is known in the art, according to which a housing of the apparatus receives a driving power from a crankshaft of an engine, and a vane rotor is provided in the housing for transmitting the driving power of the crankshaft to a cam shaft. According to the valve timing adjusting apparatus, multiple fluid chambers are formed between multiple vanes of the vane rotor, so that the vane rotor is rotated relative to the housing depending on the fluid pressure in the fluid chambers. Thus, the relative rotational phase of the cam shaft to the engine crankshaft, namely, the valve timing for the intake and/or exhaust valves, is adjusted.

In the valve timing adjusting apparatus of the above kind, the torque change is generally transmitted to the vane rotor via the cam shaft, wherein the torque change may be generated when driving to open and close the intake and/or exhaust valves. When the torque change is applied to the vane rotor in a retarding direction during an advancing operation, the working fluid in the fluid chambers may be compressed so that the working fluid tends to flow out from the fluid chambers. On the other hand, when the torque change is applied to the vane rotor in an advancing direction during a retarding operation, the working fluid in the fluid chambers may be likewise compressed so that the working fluid tends to flow out from the fluid chambers. The push-out of the working fluid from the fluid chambers may adversely affect the advancing and/or retarding operation, according to which the vane rotor is moved to its target position relative to the cam shaft. As a result, it may take a longer time until the vane rotor reaches its target position. Namely, the response is decreased.

According to Japanese Patent Publication No. 2003-106115, a check valve is provided in a fluid passage for supplying working fluid to fluid chambers, so that the push-out of the working fluid from the fluid chambers is prohibited when the torque change is applied to the cam shaft, in order to quickly achieve a target phase.

It is, however, a problem in the above valve timing adjusting apparatus, in that the vane rotor in the housing is not stably positioned due to the torque change applied to the vane rotor, when the fluid pressure in the fluid chambers is still low, shortly after the engine has been started. And a slapping sound may be generated.

According to another prior art, Japanese Patent Publication No. 2003-343218, a lock member is provided in a vane rotor, and the lock member is engaged with a housing, so that the vane rotor is locked with respect to the housing. According to the prior art, the locked condition of the vane rotor to the housing is released shortly after the start-up of the engine, wherein the fluid pressure in a certain fluid chamber is used to move the lock member from the housing in an un-locking direction.

A response for controlling the relative phase between the vane rotor and the housing to a target value is improved, when a check valve is provided in the vane rotor, and discharge (push-out) of the working fluid from the certain fluid chamber is restricted. However, the fluid pressure in the fluid chamber, for which the discharge of the working fluid is restricted by the check valve, is largely increased to a value higher than a fluid pressure of a fluid supply source, when the torque change is applied to the vane rotor.

In the case that the lock member is moved from the housing (in the un-locking direction) by the fluid pressure, which is supplied from the certain fluid chamber, the locked condition of the vane rotor to the housing may be erroneously released. If there is a small clearance between the lock member and the housing, the fluid pressure in the certain fluid chamber is rapidly increased to a higher value than that of the fluid supply source, when the torque change is applied to the vane rotor and the vane rotor is rotated relative to the housing by such a small clearance.

SUMMARY OF THE INVENTION

The present invention is made in view of the above problems. And it is, therefore, an object of the present invention to provide a valve timing adjusting apparatus, according to which a control response is improved and a generation of slapping sound is suppressed.

According to a feature of the invention, a valve timing adjusting apparatus has a housing operatively connected to and rotated together with a crankshaft of an engine, and having multiple accommodating chambers formed in a rotating direction at predetermined angular intervals. A vane rotor is operatively connected to and rotating a cam shaft of the engine, and has multiple vanes respectively accommodated in the accommodating chambers of the housing, so that each of the vanes divides each of the accommodating chamber into a retarding fluid chamber and an advancing fluid chamber. The vane rotor is relatively rotated by fluid pressure in the retarding fluid chamber and/or the advancing fluid chamber in a retarding or advancing direction with respect to the housing.

The valve timing adjusting apparatus further has a retarding fluid path and an advancing fluid path respectively provided in the housing, each of which is operatively and selectively connected to a fluid pressure source. Branched passage portions are provided in the housing for connecting the retarding fluid path with the retarding fluid chambers, for supplying pressurized working fluid from the fluid pressure source to the retarding fluid chambers when the retarding fluid path is connected to the fluid pressure source. And other branched passage portions are provided in the housing for connecting the advancing fluid path with the advancing fluid chambers for supplying pressurized working fluid from the fluid pressure source to the advancing fluid chambers when the advancing fluid path is connected to the fluid pressure source.

A lock member is movably provided in the vane rotor for locking and un-locking the vane rotor to the housing, wherein the lock member is driven to move by fluid pressure of working fluid supplied to a first fluid chamber, which is one of the retarding and advancing fluid chambers. A check valve is provided in one of the branched passage portions connected to a second fluid chamber, which is one of the retarding and advancing fluid chambers other than the first fluid chamber, wherein the check valve allows the fluid flow from the fluid pressure source to the second fluid chamber, but prohibits the fluid flow from the second fluid chamber to the fluid pressure source.

According to another feature of the invention, a bypass passage is further provided between the second fluid chamber and the fluid pressure source, so that the bypass passage bypasses the check valve, and a control valve is provided in the bypass passage for opening and closing the bypass passage in accordance with the fluid pressure of the working fluid introduced into the bypass passage from one of the branched passage portions.

According to a further feature of the invention, a control valve is provided in the valve timing adjusting apparatus, wherein the check valve is provided in the control valve. The control valve comprises a spool movably inserted into a spool hole, and having a first spool position and a second spool position. The spool is driven to move from the first to the second spool position and vice versa by the fluid pressure from one of the retarding and advancing fluid paths, wherein the second fluid chamber is communicated with the fluid pressure source when the spool is in the first spool position, in which a valve port of the check valve is bypassed, whereas the second fluid chamber is communicated with the fluid pressure source when the spool is in the second spool position, through the valve port of the check valve.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENTS

First Embodiment

Embodiments of the invention will be explained with reference to the drawings.

Figure 1:
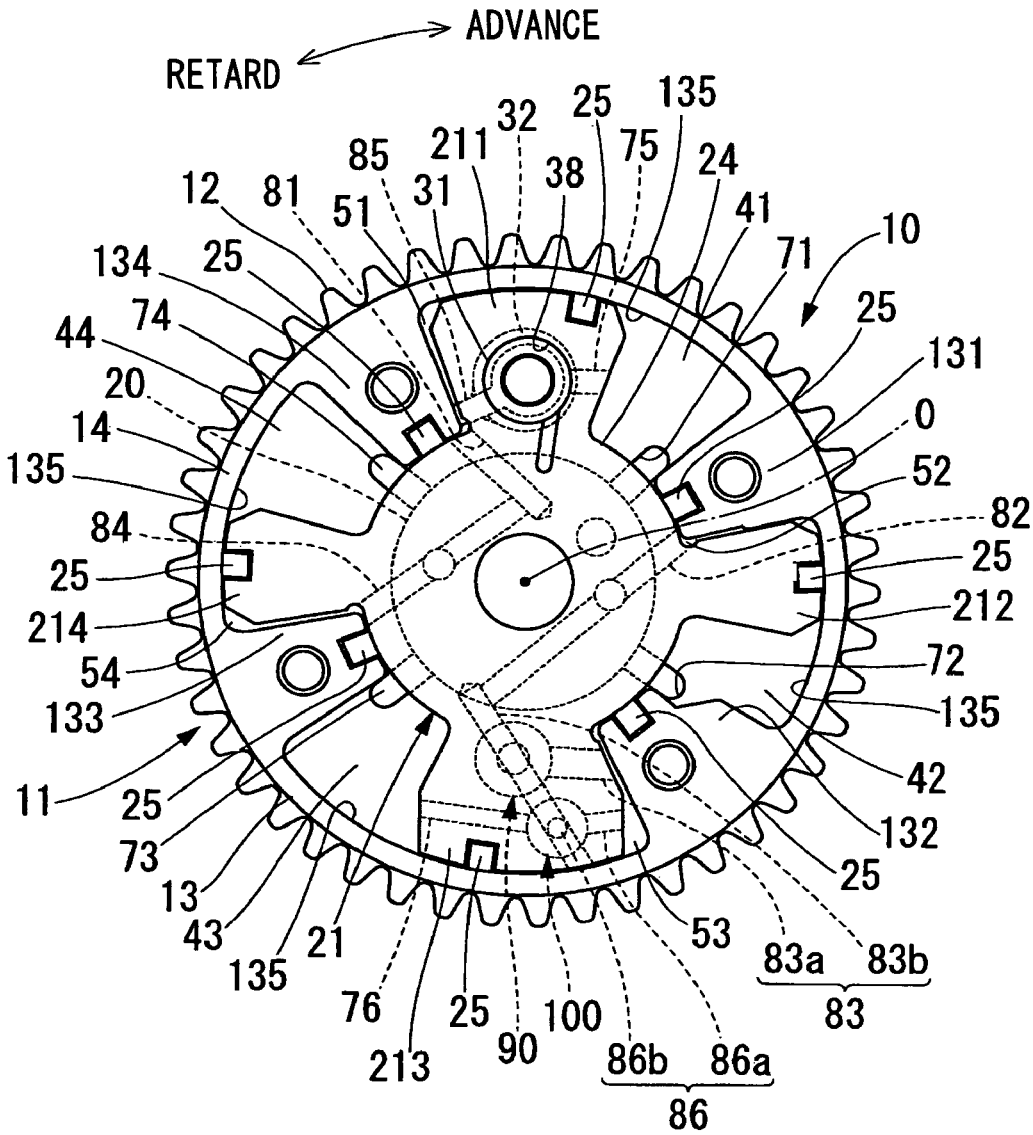
FIG. 1 is a cross sectional view, taken along a line I-I of FIG. 2, showing a valve timing adjusting apparatus according to a first embodiment.
Figure 2:
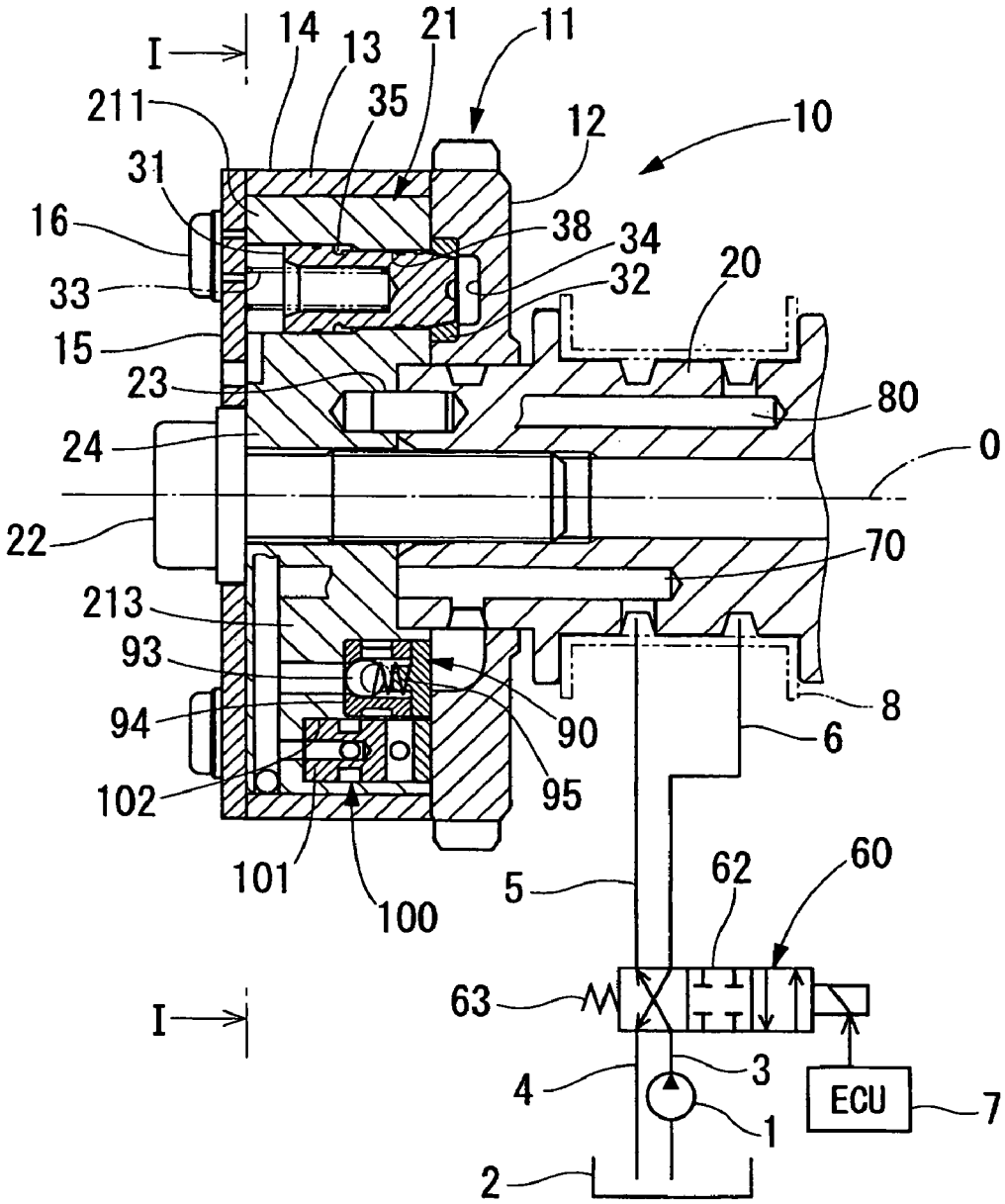
FIG. 2 is a schematic view showing the valve timing adjusting apparatus according to the first embodiment, wherein a fluid circuit and a cross section of the apparatus are shown.

A valve timing adjusting apparatus according to a first embodiment is shown in FIGS. 1 and 2. The valve timing adjusting apparatus 10 according to the embodiment is a hydraulic type, in which working oil is used as working fluid, for controlling the valve timing of an intake valve (not shown) for an internal combustion engine.

A housing 11 for a driving-side rotating unit is composed of a sprocket 12, a shoe housing 13, and a front plate 15. The shoe housing 13 has multiple shoes 131, 132, 133, and 134 as partitioning elements, and an annular wall member 14. Each of the shoes 131, 132, 133, and 134 is formed in a trapezoidal shape projecting from the annular wall member 14 in a radial and inward direction. The shoes 131, 132, 133, and 134 are arranged in a rotational direction of the housing 11, so that fan-shaped accommodating chambers 135 (four chambers 135) are formed at predetermined angular intervals. The front plate 15 is arranged at the wall member 14 on an opposite side of the sprocket 12, and fixed to the shoe housing 13 and the sprocket 12 by bolts 16. The sprocket 12 is operatively connected to a crankshaft (not shown) of the engine, which is a driving shaft of the engine, by means of a timing chain (not shown), so that the sprocket 12 is rotated in accordance with the rotation of the crankshaft when a driving power is transmitted from the crankshaft to the sprocket. The housing 11 is rotated in a clockwise direction in the embodiment of FIG. 1.

The driving power of the crankshaft is transmitted to a cam shaft 20, which is a driven-side shaft, via the valve timing adjusting apparatus 10, so that the cam shaft 20 drives the intake valves of the engine to open and close the same. The cam shaft 20 is inserted into an inner peripheral space of the sprocket 12, such that a relative rotational movement of the cam shaft 20 to the sprocket 12 is allowed. A vane rotor 21, which is a driven-side rotating unit, is accommodated in the inside of the housing 11, such that a relative rotational movement of the vane rotor 21 with respect to the housing 11 is allowed. The vane rotor 21 is coaxially fixed to the cam shaft 20 by means of a bolt 22, and positioned in a rotational direction by a positioning pin 23, so that the cam shaft 20 is integrally rotated in accordance with the rotation of the vane rotor 21. The vane rotor 21 and the cam shaft 20 are rotated in the clockwise direction in FIG. 1. Accordingly, when the vane rotor 21 and the cam shaft 20 are rotated relative to the housing 11 in the clockwise direction, such a relative rotation is referred to as a rotation in an advancing direction. On the other hand, when the vane rotor 21 and the cam shaft 20 are rotated relative to the housing 11 in an anti-clockwise direction, such a relative rotation is referred to as a rotation in a retarding direction.

The vane rotor 21 has a boss portion 24 connected to the cam shaft 20 and multiple vanes 211, 212, 213, and 214, which are projected outwardly in the radial direction and arranged in the rotational direction at predetermined intervals. Each of the vanes 211, 212, 213, and 214 is respectively accommodated in the accommodating chambers 135, to form therein an advancing fluid chamber and a retarding fluid chamber. More exactly, the retarding fluid chamber 41 is formed between the shoe 131 and the vane 211, and in the same manner the other retarding fluid chambers 42, 43, and 44 are respectively formed between the shoes 133, 134, and 135 and the vanes 212, 213, and 214. The advancing fluid chamber 51 is formed between the shoe 134 and the vane 211, and in the same manner the other advancing fluid chambers 52, 53, and 54 are formed between the shoes 131, 132, and 133 and the vanes 212, 213, and 214. As above, the retarding fluid chambers 41, 42, 43, and 44 and the advancing fluid chambers 51, 52, 53, and 54 are alternately formed in the housing 11 in the rotational direction of the vane rotor 21.

Sealing members 25 are arranged between the shoes 131, 132, 133, and 134 and the boss portion 24, and also between the vanes 211, 212, 213, and 214 and the wall member 14, so that leakage of working fluid from the retarding fluid chambers 41, 42, 43, and 44 to the advancing fluid chambers 51, 52, 53, and 54, and vice versa, is suppressed.

As shown in FIGS. 1 and 2, a stopper piston 31 is formed as a cylindrical member, which is operated as a locking member. The stopper piston 31 is slidably inserted into a cylindrical hole 38, which is formed in the vane 211 as a through-hole in an axial direction of the vane rotor 21. The stopper piston 31 is movable in a reciprocal manner in the cylindrical hole 38, in a direction parallel to a rotational center line O of the vane rotor 21. A stopper ring 32 is press inserted into the sprocket 12 and formed as an integral part of the housing 11. According to the embodiment, the stopper piston 31 is engaged with the stopper ring 32, when the relative rotational position of the vane rotor 21 to the housing 11 is in its most retarded position. When the stopper piston 31 is engaged with the stopper ring 32, the vane rotor 21 is locked with the housing 11.

An elastic member 33, such as a spring or the like, biases the stopper piston 31 toward the sprocket 12. A fluid pressure chamber 34 is formed at one side of the stopper piston 31 in the sprocket 12, and another fluid pressure chamber 35 is formed at an outer peripheral portion of the stopper piston 31. A force generated by fluid pressures in the fluid pressure chambers 34 and 35 is applied to the stopper piston 31, such that the force biases the stopper piston 31 toward the front plate 15. Accordingly, the stopper piston 31 can be brought out of the engagement from the stopper ring 32, by applying the fluid pressure to the stopper piston 31 from either one of or both of the fluid pressure chambers 34 and 35, when the stopper piston 31 is in its most retarded position.

When the stopper piston 31 becomes out of the engagement from the stopper ring 32, the locking condition of the vane rotor 21 to the housing 11 is released (un-locked), so that the relative rotation of the vane rotor 21 to the housing 11 is allowed. The fluid pressure chambers 34 and 35 keep the released condition, in which the stopper piston 31 is out of the engagement from the stopper ring 32. The fluid pressure chambers 34 and 35 are respectively communicated with the advancing fluid chamber 51 and the retarding fluid chamber 41, through an advancing fluid passage 85 and a retarding fluid passage 75.

Figure 3:
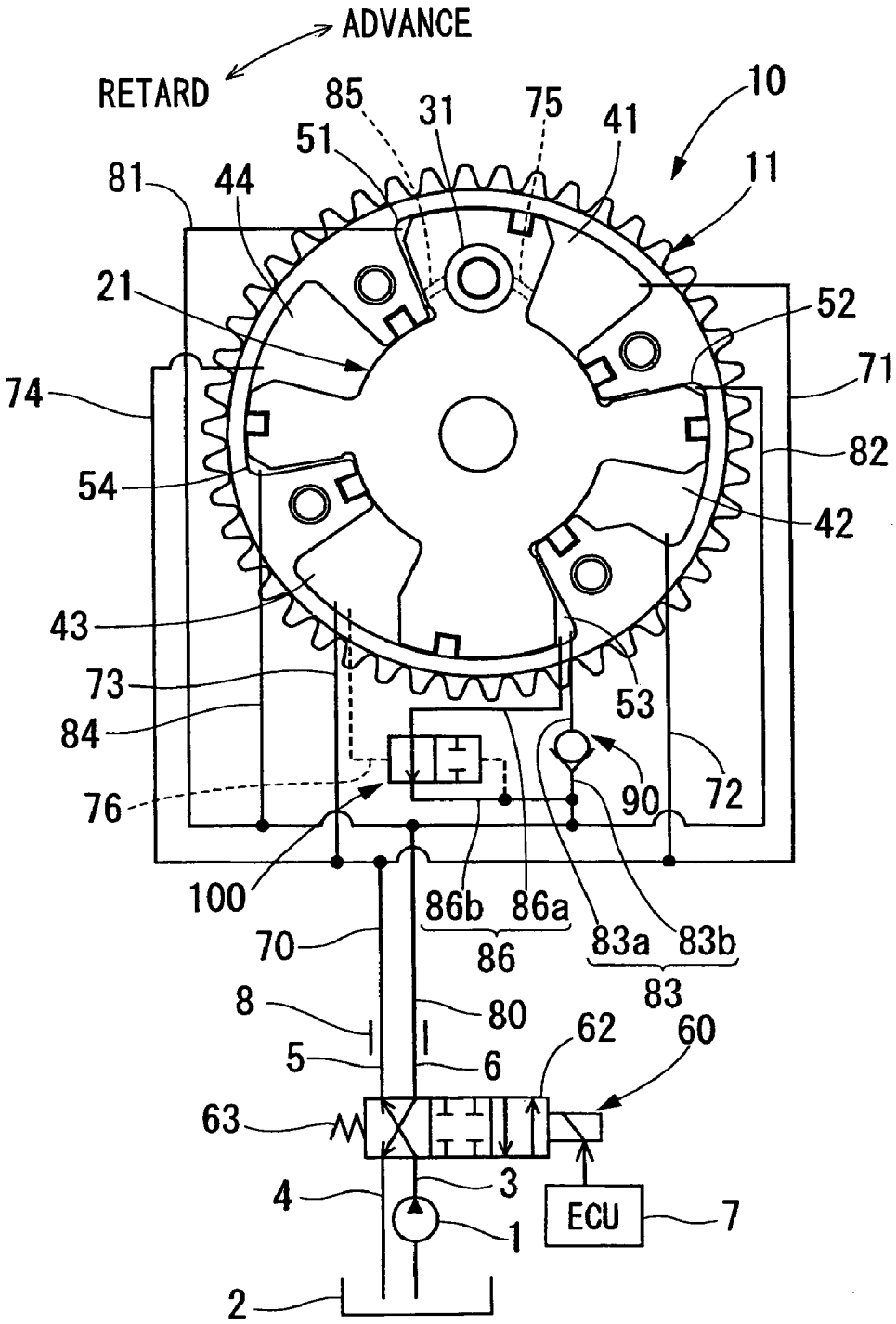
FIG. 3 is a schematic view of the apparatus, showing one of operational positions.

As shown in FIGS. 2 and 3, a pump 1 sucks the working oil from an oil tank 2 and pumps out pressurized working oil (fluid) to a supply passage 3. The working oil is returned to the oil tank 2 through a return passage 4. A switching valve 60 is provided between a bearing 8 for supporting the cam shaft 20 and the pump 1, more exactly, between the supply and return passages 3 and 4 and outside retarding and advancing fluid passages 5 and 6. The switching valve 60 is an electromagnetic type spool valve, which is driven by a driving current controlled by an electronic control unit (ECU) 7 with a duty-ratio control.

Figure 4:
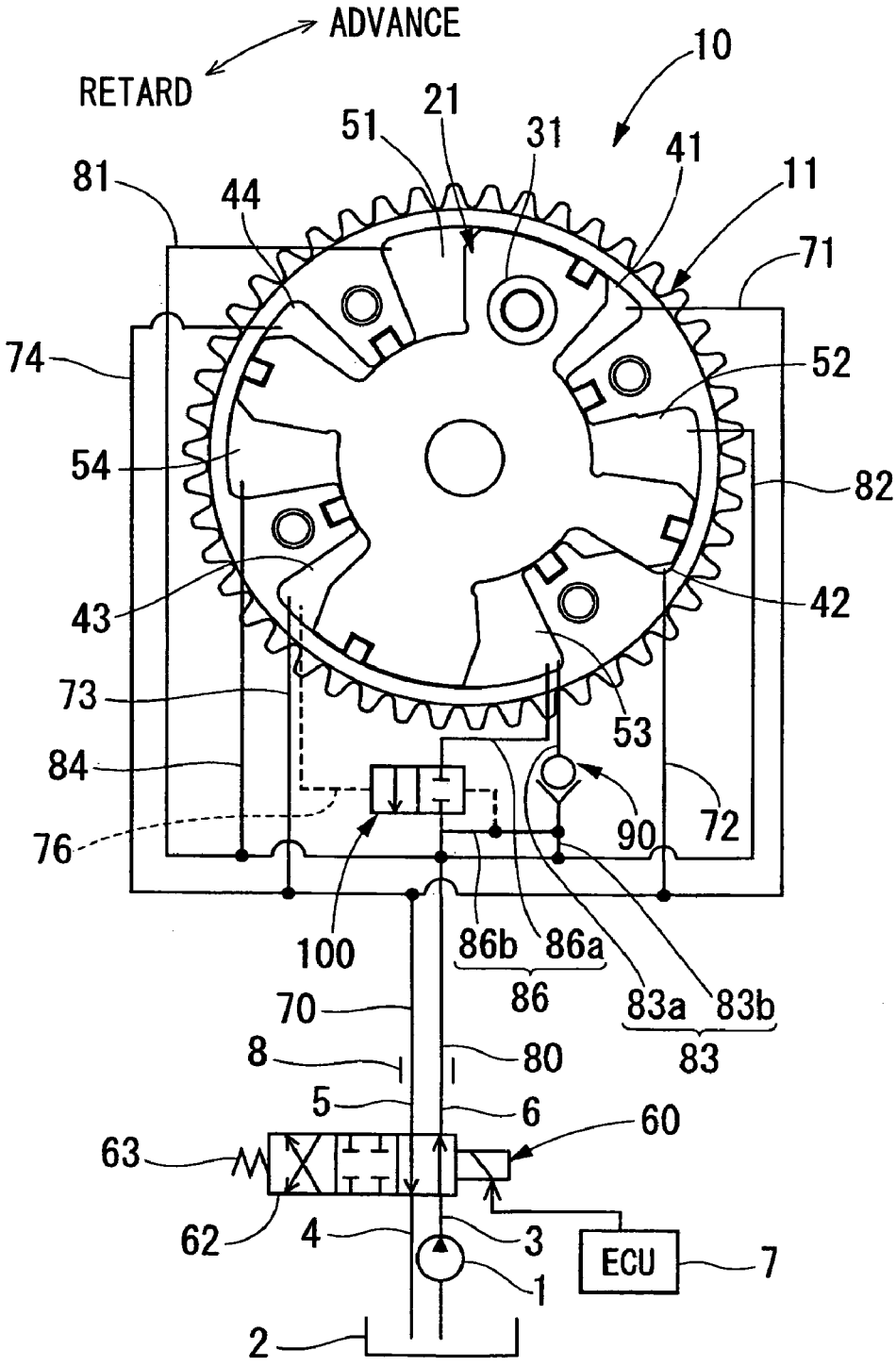
FIG. 4 is a schematic view of the apparatus, showing another operational position.

When a spool 62 of the switching valve 60 is positioned at a first valve position indicated in FIGS. 2 and 3, the outside retarding fluid passage 5 is communicated with the supply passage 3, whereas the outside advancing fluid passage 6 is communicated with the return passage 4. When the spool 62 of the switching valve 60 is positioned at a second valve position as indicated in FIG. 4, the outside advancing fluid passage 6 is communicated with the supply passage 3, whereas the outside retarding fluid passage 5 is communicated with the return passage 4.

When the spool 62 of the switching valve 60 is positioned at an intermediate valve position between the first and second valve positions, the outside retarding and advancing fluid passages 5 and 6 are cut off from the communication with the supply and return passages 3 and 4. When the driving current to the switching valve 60 is cut off, the spool 62 is biased by a spring 63 to the first valve position.

As shown in FIG. 2, a retarding fluid path 70 and an advancing fluid path 80, which are formed in the cam shaft 20, are respectively communicated with the outside retarding and advancing fluid passages 5 and 6. As shown in FIGS. 1 and 3, branched passage portions 71, 72, 73, and 74 are branched off from the retarding fluid path 70, and respectively communicated with the retarding fluid chambers 41, 42, 43, and 44. Accordingly, the pressurized working fluid supplied from the supply passage 3 and the outside retarding fluid passage 5 is respectively delivered to the retarding fluid chambers 41, 42, 43, and 44 through the branched passage portions 71, 72, 73, and 74, when the outside retarding fluid passage 5 is communicated with the supply passage 3 through the switching valve 60. On the other hand, when the outside retarding fluid passage 5 is communicated with the return passage 4, as shown in FIG. 4, the working fluid is discharged from the retarding fluid chambers 41, 42, 43, and 44 through the branched passage portions 71, 72, 73, and 74 and the retarding fluid path 70.

As shown in FIGS. 1 and 3, branched passage portions 81, 82, 83, and 84 are branched off from the advancing fluid path 80, and respectively communicated with the advancing fluid chambers 51, 52, 53, and 54. Accordingly, the pressurized working fluid supplied from the supply passage 3 and the outside advancing fluid passage 6 is respectively delivered to the advancing fluid chambers 51, 52, 53, and 54 through the branched passage portions 81, 82, 83, and 84, when the outside advancing fluid passage 6 is communicated with the supply passage 3 through the switching valve 60. On the other hand, when the outside advancing fluid passage 6 is communicated with the return passage 4, as shown in FIG. 3, the working fluid is discharged from the advancing fluid chambers 51, 52, 53, and 54 through the branched passage portions 81, 82, 83, and 84 and the advancing fluid path 80. The discharge of the working fluid from the advancing fluid chamber 53 to the return passage 4 is realized by a bypass passage 86, the advancing fluid path 80 and the outside advancing fluid passage 6, which will be explained below.

As shown in FIGS. 1, 2 and 5, a check valve 90 is provided in the vane 213, which is at an opposite side of the vane 211, with respect to the rotational center line O, in which the stopper piston 31 is inserted. The check valve 90 is provided at an intermediate portion of the branched passage portion 83, which connects the advancing fluid path 80 with the advancing fluid chamber 53.

The check valve 90 is composed of a holder member 94, an elastic member 95 and a valve member 93. The holder member 94 is formed in a cylindrical shape and press inserted into the vane 213. The holder member 94 has a valve passage 97, which is communicated at one side with a first passage portion 83*a* connected to the advancing fluid chamber 53 and at the other side thereof with a second passage portion 83*b* connected to the advancing fluid path 80. A valve seat 96 is formed at the other side of the valve passage 97. The elastic member 95 is composed of a spring accommodated in the valve passage 97. The valve member 93 is formed in a ball shape, and is also accommodated in the valve passage 97, such that the valve member 93 is movable in a reciprocating manner in a direction parallel to the rotational center line O of the cam shaft 20, and a valve port 98 is closed when the valve member 93 is seated on the valve seat 96. According to the above structure, the fluid pressure in the first passage portion 83*a* is applied to the valve member 93 in a valve closing direction, namely in a direction toward the valve seat 96. On the other hand, the fluid pressure in the second passage portion 83*b* is applied to the valve member 93 in the opposite direction, namely in the direction away from the valve seat 96. The valve member 93 is biased to the valve seat 96 by a restoring force of the elastic member 95.

Figure 5A:
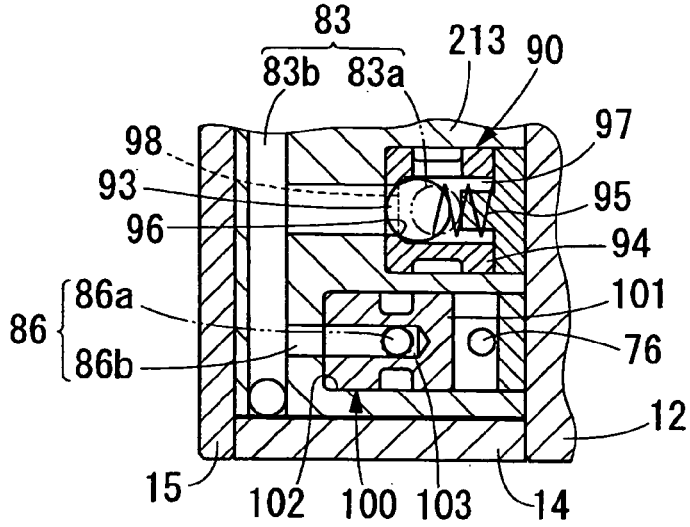
FIGS. 5A, 5B and 5C are cross sectional views, respectively showing a major portion (a check valve and a control valve) of the apparatus according to the first embodiment.
Figure 5B:
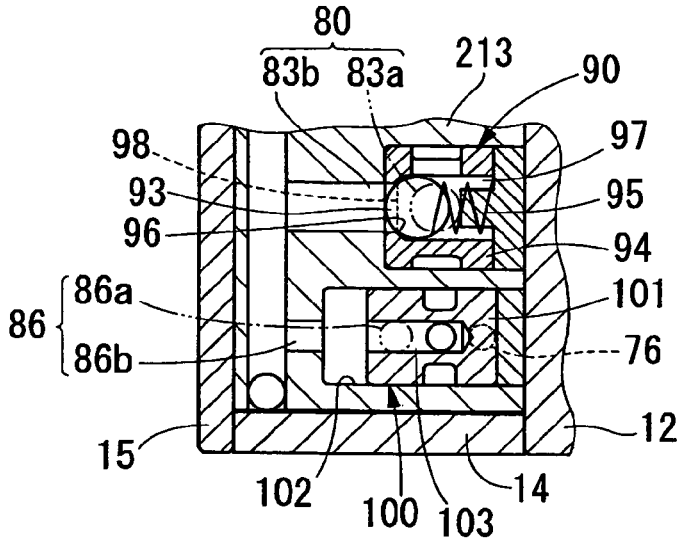
Figure 5C:
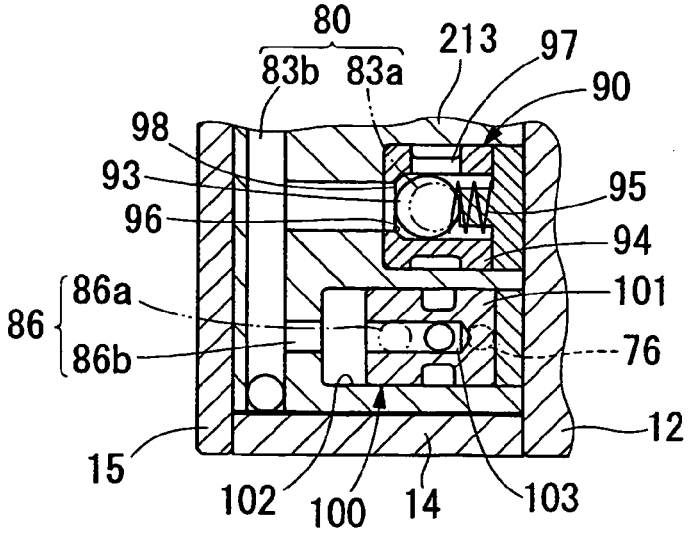

According to the above structure of the check valve 90, as shown in FIG. 5C, the valve passage 97 is opened when the valve member 93 is separated from the valve seat 96 upon receiving the fluid pressure from the second passage portion 83*b*. When the check valve 90 is opened as above, the working fluid is allowed to flow from the advancing fluid path 80 to the advancing fluid chamber 53 through the valve port 98.

On the other hands, as shown in FIGS. 5A and 5B, the valve passage 97 is closed when the valve member 93 is seated on the valve seat 96 upon receiving the restoring force from the elastic member 95 and the fluid pressure from the first passage portion 83*a*. When the check valve 90 is closed as above, the working fluid is prevented from flowing from the advancing fluid chamber 53 to the advancing fluid path 80 through the valve port 98.

As shown in FIGS. 1 and 3, a control valve 100 is provided in the vane 213 like the check valve 90 at an intermediate portion of the bypass passage 86. As shown in FIGS. 2 and 5, the control valve 100 is a spool valve, which is composed of a spool hole 102 and a spool 101 as a valve member. The spool hole 102 is formed in the vane 213, so that the spool hole 102 is communicated with a third passage portion 86*a* connected to the advancing fluid chamber 53 and with a fourth passage portion 86*b* connected to the second passage portion 83*b*. Accordingly, the bypass passage 86 bypasses the check valve 90 but connects the advancing fluid chamber 53 with the advancing fluid path 80 through the control valve 100 and the second passage portion 83*b*.

The spool hole 102 is further connected to a retarding bypass passage 76. The spool 101 is formed in a cylindrical shape having a closed bottom. The spool 101 is slidably inserted into the spool hole 102, so that the spool 101 is reciprocatingly movable in the spool hole 102 in a direction parallel to the rotational center line O of the cam shaft 20. A communication port 103 is formed in the spool 101, such that one end of the communication port 103 is always in communication with the fourth passage portion 86*b*, whereas the other end of the communication port 103 becomes in communication with the third passage portion 86*a* when the spool 101 is moved to a position shown in FIG. 5A. The spool 101 receives fluid pressures from the fourth passage portion 86*b* and from the retarding bypass passage 76. Namely, the fluid pressure from the fourth passage portion 86*b* biases the spool 101 toward the sprocket 12, whereas the fluid pressure from the retarding bypass passage 76 biases the spool 101 toward the front plate 15.

When the spool 101 is moved to a first spool position (a passage opening position), as shown in FIG. 5A, the third passage portion 86*a* is communicated with the fourth passage portion 86*b* through the communication port 103, so that the bypass passage 86 is opened. With this first spool position of the control valve 100, the working fluid is allowed to flow from the advancing fluid chamber 53 to the advancing fluid path 80, wherein the working fluid bypasses the valve port 98 of the check valve 90.

On the other hand, when the spool 101 is moved to a second spool position (a passage closing position), as shown in FIG. 5B or 5C, the communication between the third passage portion 86*a* and the fourth passage portion 86*b* through the communication port 103 is cut off, so that the bypass passage 86 is closed. With this second spool position of the control valve 100, the working fluid is prevented from flowing from the advancing fluid chamber 53 to the advancing fluid path 80.

An operation of the valve timing adjusting apparatus 10 according to the first embodiment will be explained. When the engine operation is stopped, the vane rotor 21 is positioned at the most retarded position, wherein the stopper piston 31 is engaged with the stopper ring 32. When the engine is stopped, the operation of the pump 1 is likewise stopped. During the engine operation, however, the pump 1 is continuously operated.

(Start-Up Operation of the Engine)

At starting up operation of the engine, the sufficient pressurized working fluid is not yet supplied from the pump 1 to the retarding fluid chambers 41, 42, 43, and 44, the advancing fluid chambers 51, 52, 53, and 54, and the fluid pressure chambers 34 and 35. Therefore, the stopper piston 31 is held in the locked condition in which it is engaged with the stopper ring 32 by the biasing force of the elastic member 33. The vane rotor 21 is locked at its most retarded position with respect to the housing 11. Accordingly, generation of slapping sound due to vibration of relative rotation between the vane rotor 21 and the housing 11 is prevented, which is otherwise caused by torque change transmitted to the vane rotor 21 from the intake valves via the cam shaft 20.

(Advancing Operation)

When the power supply to the switching valve 60 is turned on by the ECU 7, the spool 62 is moved to the second valve position indicated in FIG. 4 by the electromagnetic driving force against the restoring force of the spring 63. Then, the pressurized working fluid from the pump 1 is supplied to the branched passage portions 81, 82, 83*b*, and 84 through the supply passage 3, the outside advancing fluid passage 6, and the advancing fluid path 80. When the fluid pressure in the second passage portion 83*b* and the fourth passage portion 86*b* is increased, as shown in FIG. 5C, the check valve 90 is opened and the bypass passage 86 is closed by the control valve 100, so that the pressurized working fluid is supplied from the second passage portion 83*b* into the advancing fluid chamber 53.

At the same time, the pressurized working fluid is supplied into the other advancing fluid chambers 51, 52, and 54 from the branched passage portions 81, 82, and 84. And further, the pressurized working fluid is supplied into the fluid pressure chamber 34 through the advancing fluid chamber 51 and the advancing fluid passage 85. When the fluid pressure in the fluid pressure chamber 34 is increased, the stopper piston 31 is brought out of the engagement from the stopper ring 32, so that the locked condition of the vane rotor 21 to the housing 11 is released (un-locked).

On the other hand, the working fluid of the retarding fluid chambers 41, 42, 43, and 44 is discharged to the return passage 4 through the branched passage portions 71, 72, 73, and 74, the retarding fluid path 70, and the outside retarding fluid passage 5. As above, on one hand, the pressurized working fluid is supplied into the advancing fluid chambers 51, 52, 53, and 54, whereas the working fluid is discharged from the retarding fluid chambers 41, 42, 43, and 44 on the other hand. As a result, the vane rotor 21 receives the fluid pressures in the respective advancing fluid chambers 51, 52, 53, and 54, so that the vane rotor 21 is rotated in the advancing direction with respected to the housing 11.

The torque change may be applied to the vane rotor 21 in the advancing and/or retarding direction with respect to the housing 11, during the operation of the vane rotor 21, in which the vane rotor 21 is moved to its target position of the advancing side by supplying the pressurized working fluid into the advancing fluid chambers 51, 52, 53, and 54 and by discharging the working fluid from the retarding fluid chambers 41, 42, 43, and 44. On the average of the torque changes which are applied to the vane rotor 21, the torque change in the retarding direction is larger than that in the advancing direction. When the vane rotor 21 receives the torque change in the retarding direction, the working fluid in the advancing fluid chambers 51, 52, 53, and 54 is compressed, so that the working fluid is likely to flow out (pushed out) to the branched passage portions 81, 82, 83*a*, and 84. However, at this situation, since the check valve 90 is closed to cut off the communication in the branched passage portion 83, and also the bypass passage 86 is closed by the control valve 100, as shown in FIG. 5B, the working fluid is not allowed to flow from the advancing fluid chamber 53 to the advancing fluid path 80. Accordingly, the vane rotor 21 is not moved back to the retarding direction, even when the vane rotor 21 received the torque change in the retarding direction and when the fluid pressure of the working fluid from the pump 1 has not reached its sufficient high pressure. Furthermore, as a result, the working fluid is not discharged from the other advancing fluid chambers 51, 52, and 54, either. As above, the vane rotor 21 is prevented from moving back in the retarding direction, which is the opposite direction to the target position, even when the torque change is applied to the vane rotor 21. The vane rotor 21 is, therefore, smoothly moved to its target position on the advancing side in a shorter period.

The fluid pressure in the advancing fluid chamber 53 is largely increased, because the advancing fluid chamber 53 receives the whole reaction force of the torque change, when the vane rotor 21 receives the torque change in the retarding direction and is restricted to move in the retarding direction due to the check valve 90 blocking the reverse flow. On the other hand, the fluid pressure in the remaining advancing fluid chambers 51, 52, and 54 is hardly increased and maintained at such a pressure of the pressurized fluid from the pump 1, because the working fluid in those advancing fluid chambers 51, 52, and 54 does not receive the reaction force of the torque change.

Since the stopper piston 31 is released (un-locked) from the locked condition by the fluid pressure in the advancing fluid chamber 51, the position of the stopper piston 31 depends on the fluid pressure of the working fluid from the pump 1. A small clearance exists in the rotational direction between the stopper piston 31 and the stopper ring 32, shortly before the stopper piston 31 is released from the locked condition. When the torque change is applied to the vane rotor 21 during the advancing operation, the vane rotor 21 is slightly moved back in the retarding direction by the above clearance. The fluid pressure in the advancing fluid chamber 53 is increased by such slight movement of the vane rotor in the retarding direction, but the fluid pressure in the advancing fluid chamber 51 is not increased. Accordingly, the stopper piston 31 is not erroneously and quickly released from its locked condition.

(Retarding Operation)

When the power supply to the switching valve 60 is cut off by the ECU 7, the spool 62 is moved to the first valve position indicated in FIG. 3 by the restoring force of the spring 63. Then, the pressurized working fluid from the supply passage 3 (the pump 1) is supplied to the outside retarding fluid passage 5, and further supplied into the respective retarding fluid chambers 41, 42, 43, and 44 through the retarding fluid path 70 and the branched passage portions 71, 72, 73, and 74. The working fluid of the advancing fluid chambers 51, 52, and 54 is discharged to the return passage 4 through the branched passage portions 81, 82, and 84, the advancing fluid path 80, and the outside advancing fluid passage 6.

At the same time, the working fluid in the second passage portion 83*b* and the fourth passage portion 86*b* is discharged to the return passage 4 through the advancing fluid path 80, and the outside advancing fluid passage 6. Accordingly, the fluid pressure in the first passage portion 83*a* becomes higher than that in the second passage portion 83*b*, so that the check valve 90 is closed, as shown in FIG. 5A, wherein the valve member 93 is seated on the valve seat 96. The branched passage portion 83 is, therefore, closed.

On the other hand, the fluid pressure in the retarding bypass passage 76 connected to the retarding fluid chamber 43 becomes higher than that in the fourth passage portion 86*b*, the control valve 100 opens the bypass passage 86, as shown in FIG. 5A. As a result, the working fluid in the advancing fluid chamber 53 is discharged to the return passage 4 through the bypass passage 86, the second passage portion 83*b*, the advancing fluid path 80, and the outside advancing fluid passage 6.

As above, on one hand, the pressurized working fluid is supplied into the retarding fluid chambers 41, 42, 43, and 44, whereas the working fluid is discharged from the advancing fluid chambers 51, 52, 53, and 54 on the other hand. As a result, the vane rotor 21 receives the fluid pressures in the respective retarding fluid chambers 41, 42, 43, and 44, so that the vane rotor 21 is rotated in the retarding direction with respected to the housing 11.

(Holding Operation)

The spool 62 is moved to its intermediate position by the driving current from the ECU 7, when the vane rotor 21 reached its target vane position, wherein the duty-ratio for the driving current to be supplied to the switching valve 60 is controlled by the ECU 7. The spool 62 is held at its intermediate position (holding position), wherein the communication between the outside retarding and advancing fluid passages 5 and 6 and the supply passage 3 (the pump 1) and the return passage 4 is cut off. The working fluid is prevented from flowing from the respective retarding and advancing fluid chambers (41 to 44, 51 to 54) to the return passage 4, so that the vane rotor 21 is held at its target vane position.

According to the above first embodiment, the discharge of the working fluid from the advancing fluid chamber 53 is prevented by the closed check valve 90 and the cut-off of the bypass passage 86 by the control valve 100, during the period in which the fluid pressure of the working fluid pumped out from the pump 1 is low. Accordingly, although the fluid pressure in the advancing fluid chamber 53 becomes higher than the fluid pressure of the pump 1, the fluid pressure in the advancing fluid chamber 51 connected to the pressure fluid chamber 34 for the stopper piston 31 is not increased and the fluid pressure in the advancing fluid chamber 51 is maintained at the fluid pressure of the pump 1. As a result, the erroneous operation for releasing the locked condition of the stopper piston 31 is prevented, so that the erroneous and quick movement of the stopper piston 31 is prevented. The generation of the slapping sound is thereby prevented. Furthermore, the response of the advancing operation is improved by preventing the discharge of the working fluid from the advancing fluid chamber 53 during the advancing operation, because the function of the check valve 90 is not adversely affected by the control valve 100.

According to the above first embodiment, there are multiple fluid chambers between the advancing fluid chamber 51 (connected to the pressure fluid chamber 34) and the advancing fluid chamber 53 (in which the discharge of the working fluid is prevented by the check valve 90). Accordingly, even if a part of the working fluid has leaked from the advancing fluid chamber 53, in which the fluid pressure of the working fluid is largely increased due to the function of the check valve 90, the leaked working fluid may not easily reach to the advancing fluid chamber 51. This operation (effect) is enhanced by the multiple sealing members 25. Namely, the increase of the fluid pressure in the advancing fluid chamber 51 as well as in the pressure fluid chamber 34 is prevented, which would be otherwise caused by the leaked working fluid from the advancing fluid chamber 53.

Furthermore, according to the above first embodiment, the vanes 211 and 213 are arranged at opposite directions with respect to the rotational center line O of the vane rotor 21, wherein the stopper piston 31 is provided in the vane 211, whereas the check valve 90 as well as the control valve 100 is provided in the other vane 213. Accordingly, the center of gravity for the vane rotor 21 can be made closer to the rotational center line O, so that a balance of rotational inertia is not largely deviated and the rotation of the vane rotor 21 becomes stable.

Furthermore, according to the above first embodiment, the check valve 90 and the control valve 100 are provided in the same vane 213, which is adjacent to the advancing fluid chamber 53. The first passage portion 83*a* (connecting the check valve 90 with the advancing fluid chamber 53) and the third passage portion 86*a* (connecting the control valve 100 with the advancing fluid chamber 53) can be made shorter. The vane 213 is thereby prevented from increasing its size due to the incorporation of the check valve 90 and the control valve 100. At the same time, man-power for manufacturing the passage portions can be reduced.

A part of the second passage portion 83*b* and a part of the fourth passage portion 86*b* are commonly used to each other, because the second passage portion 83*b* connects the advancing fluid path 80 with the check valve 90 and the fourth passage portion 86*b* connects the advancing fluid path 80 with the control valve 100. In this meaning, too, the size of the vane 213 is suppressed from increasing and the man-power for manufacturing the passage portions is reduced.

Second Embodiment

Figure 6:
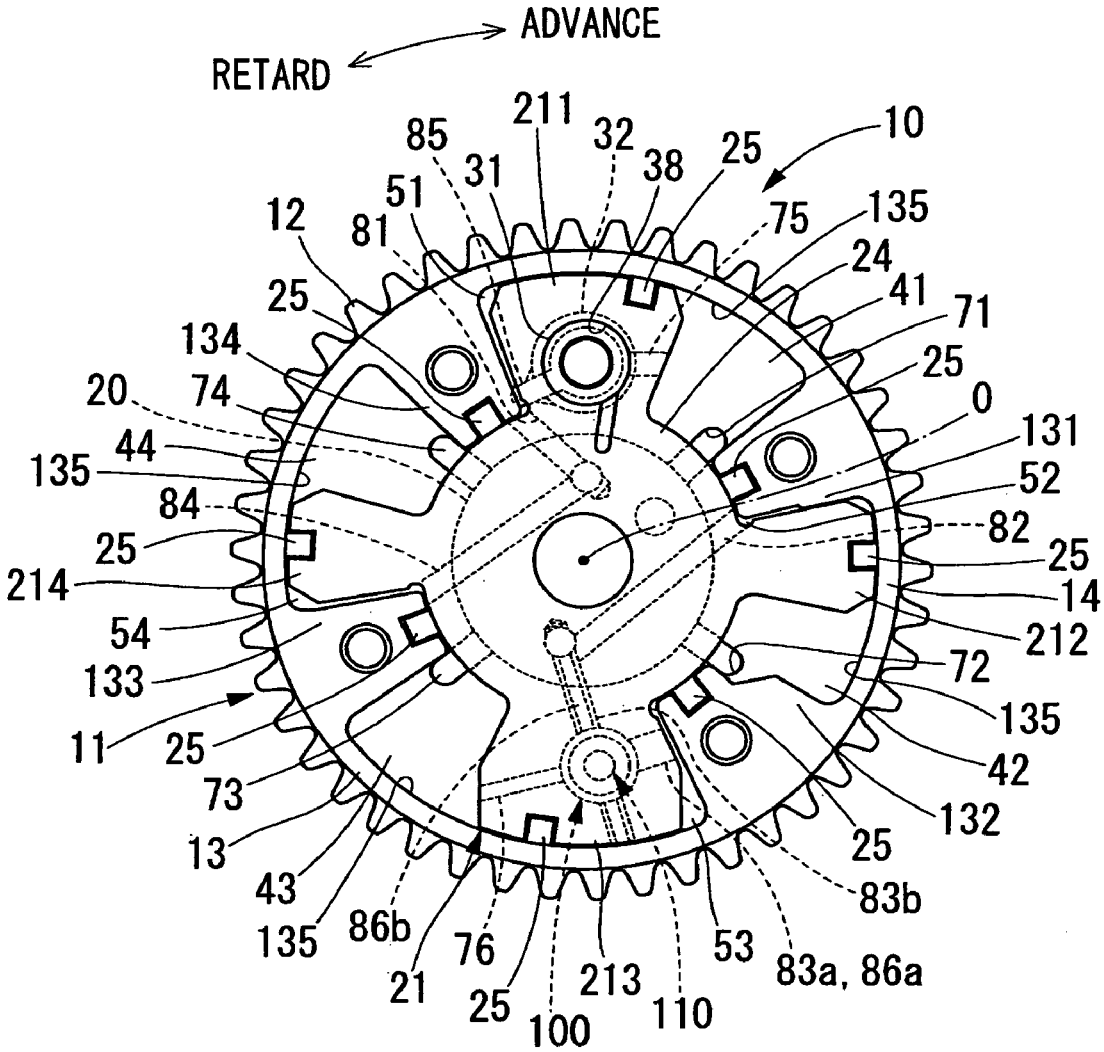
FIG. 6 is a cross sectional view showing a valve timing adjusting apparatus according to a second embodiment.
Figure 7:
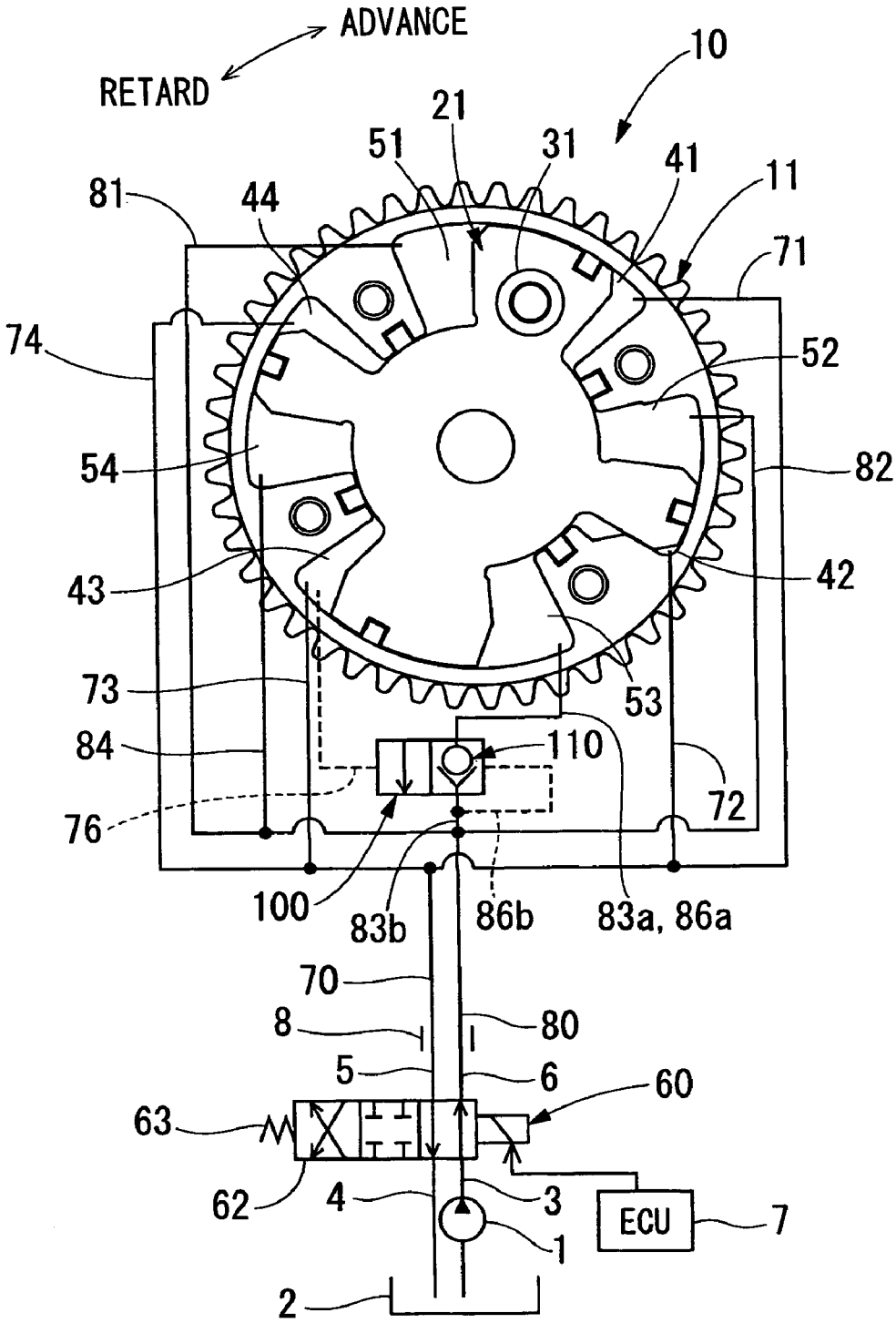
FIG. 7 is a schematic view of the apparatus according to the second embodiment, showing one of operational positions.
Figure 8A:
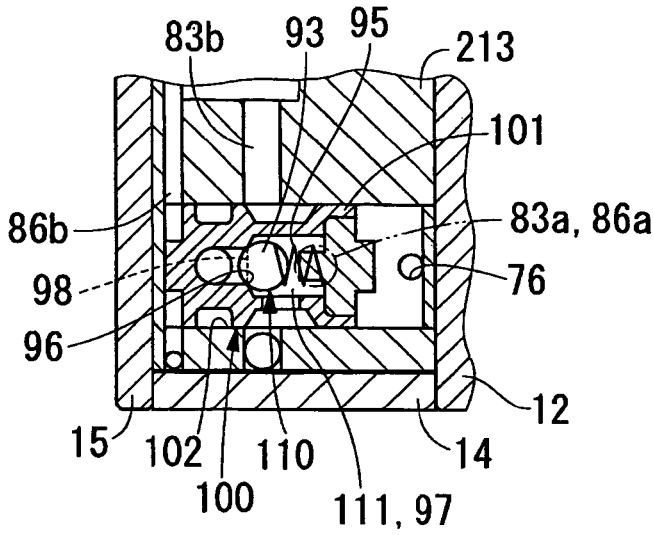
FIGS. 8A, 8B and 8C are cross sectional views, respectively showing a major portion (a control valve having a check valve) of the apparatus according to the second embodiment.

A valve timing adjusting apparatus 10 according to a second embodiment of the present invention is shown in FIGS. 6 to 8, which is a modification of the first embodiment. The same reference numerals are used here to designate the same or substantially the same parts of the first embodiment.

According to the valve timing adjusting apparatus 10 of the second embodiment, a check valve 110 is provided, not directly in the vane 213, but in the spool 101 of the control valve 100, which is provided in the vane 213.

The check valve 110 does not have a member corresponding to the holder member 94 of the first embodiment. Instead, a communication passage 111 of the spool 101 is commonly used as the valve passage 97 of the check valve 110, and the valve seat 96 is formed for the check valve 110 at an internal periphery of the communication passage 111. The third passage portion 86*a* is commonly used as the first passage portion 83*a*, wherein the third passage portion 86*a* (including the first passage portion 83*a*) is always in communication with the communication passage 111 (97).

Figure 8B:
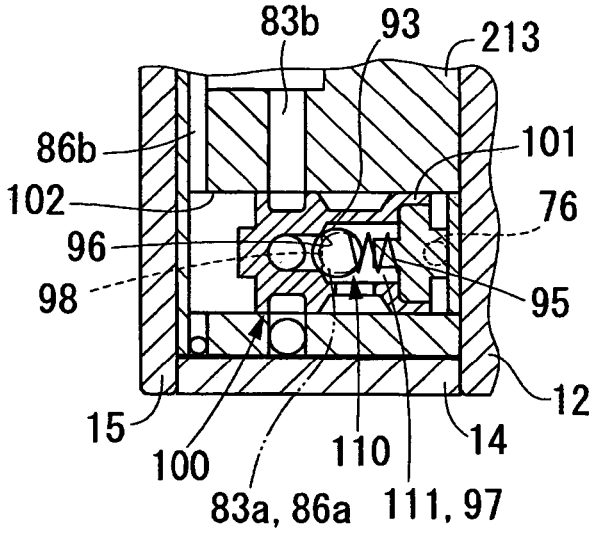

The second passage portion 83*b* is always in communication with the communication passage 111 (a left-hand portion thereof). The communication between the first passage portion 83*a* (including the third passage portion 86*a*) and the second passage portion 83*b* is cut off, when the valve member 93 is seated on the valve seat 96, as shown in FIG. 8B.

An operation of the valve timing adjusting apparatus 10 of the second embodiment will be explained below.

(Start-Up Operation of the Engine)

At starting up the operation of the engine, as in the same manner to the first embodiment, the stopper piston 31 is held in the locked condition of the engagement with the stopper ring 32. The vane rotor 21 is, therefore, locked at its most retarded position.

(Advancing Operation)

When the power supply to the switching valve 60 is turned on by the ECU 7, the pressurized working fluid from the pump 1 is supplied to the branched passage portions 81, 82, 83*b*, and 84 through the advancing fluid path 80, as in the same manner to the first embodiment. When the fluid pressure in the second passage portion 83*b* and the fourth passage portion 86*b* is increased, as shown in FIG. 8C, the valve member 93 is separated from the valve seat 96, so that the check valve 110 is opened.

Figure 8C:
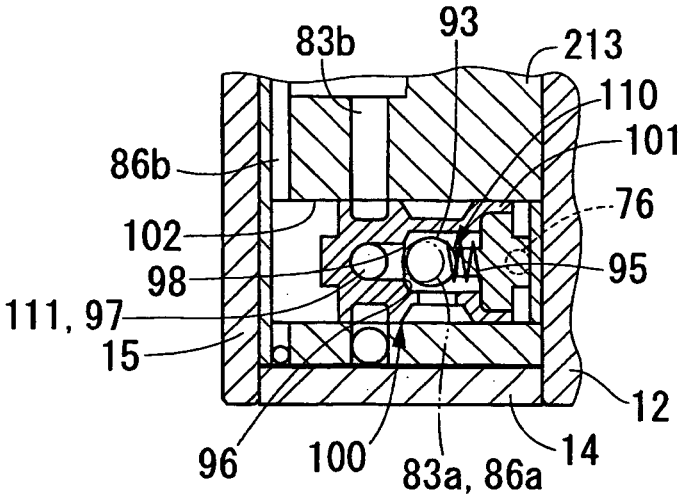

At the same time, the spool 101 of the control valve 100 is moved to the valve position shown in FIG. 8C by the fluid pressure in the fourth passage portion 86*b*, at which the communication is cut off between the advancing fluid chamber 53 and the second passage portion 83*b* through a fluid passage bypassing the valve port 98 of the check valve 110. In other words, the advancing fluid chamber 53 is communicated with the second passage portion 83*b* only through the valve port 98. Accordingly, the pressurized working fluid is supplied from the advancing fluid path 80 into the advancing fluid chamber 53 through the valve port 98, whereas the reverse flow of the working fluid from the advancing fluid chamber 53 to the advancing fluid path 80 bypassing the valve port 98 is prohibited.

As in the same manner to the first embodiment, the pressurized working fluid is supplied into the other advancing fluid chambers 51, 52, and 54 through the branched passage portions 81, 82, and 84. Furthermore, the pressurized working fluid is supplied from the advancing fluid chamber 51 to the fluid pressure chamber 34 through the advancing fluid passage 85, so that the stopper piston 31 becomes out of the engagement from the stopper ring 32 to release the locked condition of the vane rotor 21 with respect to the housing 11.

The working fluid of the retarding fluid chambers 41, 42, 43, and 44 is discharged to the return passage 4, as in the same manner to the first embodiment. As a result, the vane rotor 21 receives the fluid pressures in the respective advancing fluid chambers 51, 52, 53, and 54, so that the vane rotor 21 is rotated in the advancing direction with respected to the housing 11.

The working fluid is compressed in the advancing fluid chamber 53 and the fluid pressure in the advancing fluid chamber 53 and the first passage portion 83*a* is accordingly increased, when the vane rotor 21 receives the torque change in the retarding direction during the phase-control operation of the vane rotor 21 toward the target position on the advancing side. As a result, the check valve 110 provided in the control valve 100 is closed as shown in FIG. 8B. At this position (FIG. 8B), the reverse flow of the working fluid from the advancing fluid chamber 53 to the advancing fluid path 80 bypassing the valve port 98 is still prohibited.

Accordingly, the working fluid may not be discharged from the advancing fluid chamber 53 to the advancing fluid path 80, due to the operation of the check valve 110 and the control valve 100. Accordingly, the vane rotor 21 is not moved back to the retarding direction, even when the vane rotor 21 received the torque change in the retarding direction and when the fluid pressure of the working fluid from the pump 1 has not reached its sufficient high pressure. The vane rotor 21 is, therefore, smoothly and quickly moved to its target position on the advancing side.

The fluid pressure in the advancing fluid chamber 53 is largely increased, because the advancing fluid chamber 53 receives the whole reaction force of the torque change, when the vane rotor 21 receives the torque change in the retarding direction and is restricted to move in the retarding direction due to the check valve 110 blocking the reverse flow. On the other hand, the fluid pressure in the remaining advancing fluid chambers 51, 52, and 54 is hardly increased and maintained at such a pressure of the pressurized fluid from the pump 1, because the working fluid in those advancing fluid chambers 51, 52, and 54 does not receive the reaction force of the torque change.

Since the stopper piston 31 is released from the locked condition by the fluid pressure in the advancing fluid chamber 51, the position of the stopper piston 31 depends on the fluid pressure of the working fluid from the pump 1. A small clearance exists in the rotational direction between the stopper piston 31 and the stopper ring 32, shortly before the stopper piston 31 is released from the locked condition. When the torque change is applied to the vane rotor 21 during the advancing operation, the vane rotor 21 is slightly moved back in the retarding direction by the above clearance. The fluid pressure in the advancing fluid chamber 53 is increased by such slight movement of the vane rotor in the retarding direction, but the fluid pressure in the advancing fluid chamber 51 is not increased. Accordingly, the stopper piston 31 is not erroneously and quickly released from its locked condition.

(Retarding Operation)

As in the same manner to the first embodiment, when the power supply to the switching valve 60 is cut off by the ECU 7, the pressurized working fluid from the supply passage 3 is supplied into the respective retarding fluid chambers 41, 42, 43, and 44, whereas the working fluid in the advancing fluid chambers 51, 52, and 54 as well as in the passage portions 83*b*, 86*b* is discharged to the return passage 4. Then, the fluid pressure in the retarding bypass passage 76 (connected to the retarding fluid chamber 43) becomes higher than that in the fourth passage portion 86*b*, so that the spool 101 is moved to the valve position shown in FIG. 8A. At this valve position (FIG. 8A), the left-hand portion of the communication passage 111 (which is on the left-hand side of the valve member 93 with respect to the valve seat 96) is disconnected from the second passage portion 83*b*, so that the valve member 93 is seated on the valve seat 96 by the spring force of the elastic member 95. Namely, the check valve 110 is closed. As a result that the spool 101 is moved to the position shown in FIG. 8A, the first passage portion 83*a* (including the third passage portion 86*a*) is brought into the communication with the second passage portion 83*b*, wherein the fluid passage connecting the first passage portion 83*a* with the second passage portion 83*b* bypasses the valve port 98. Accordingly, the working fluid is discharged from the advancing fluid chamber 53 to the return passage 4 through the first passage portion 83*a*, the second passage portion 83*b*, the advancing fluid path 80, and the outside advancing fluid passage 6. Consequently, the vane rotor 21 receives the fluid pressures in the respective retarding fluid chambers 41, 42, 43, and 44, so that the vane rotor 21 is rotated in the retarding direction with respected to the housing 11.

(Holding Operation)

The vane rotor 21 is held at its target vane position, as in the same manner to the first embodiment, after the vane rotor 21 is moved to the target vane position in accordance with the above operation.

According to the above second embodiment, the fluid pressure in the advancing fluid chamber 53 may become higher than the fluid pressure pumped out from the pump 1, when the discharge of the working fluid from the advancing fluid chamber 53 is prohibited and when the fluid pressure pumped out from the pump 1 is low. In this case, however, the fluid pressure in the advancing fluid chamber 51, which is connected to the pressure fluid chamber 34 for driving the stopper piston 31, is not increased but maintained at the pressure of the fluid pressure pumped out from the pump 1. As a result, the erroneous operation for releasing the locked condition of the stopper piston 31 is prevented during the advancing operation, so that the generation of the slapping sound is prevented. Furthermore, the response of the advancing operation is improved by prohibiting the discharge of the working fluid from the advancing fluid chamber 53 during the advancing operation, because the function of the check valve 110 is not adversely affected by the control valve 100.

Furthermore, according to the above second embodiment, the check valve 110 is provided in the spool 101 of the control valve 100, which is provided in the vane 213. As a result, the length of the passage portion 83*a* (including the passage portion 86*a*), which commonly connects the check valve 110 and the control valve 100 with the advancing fluid chamber 53, is made shorter, and the total size of the valves is thereby made smaller. The increase of the size for the vane 213, which would be caused by providing the check valve 110 and the control valve 100 in the vane 213, is suppressed and the man-power for manufacturing the passage portions is reduced.

Third Embodiment

Figure 9:
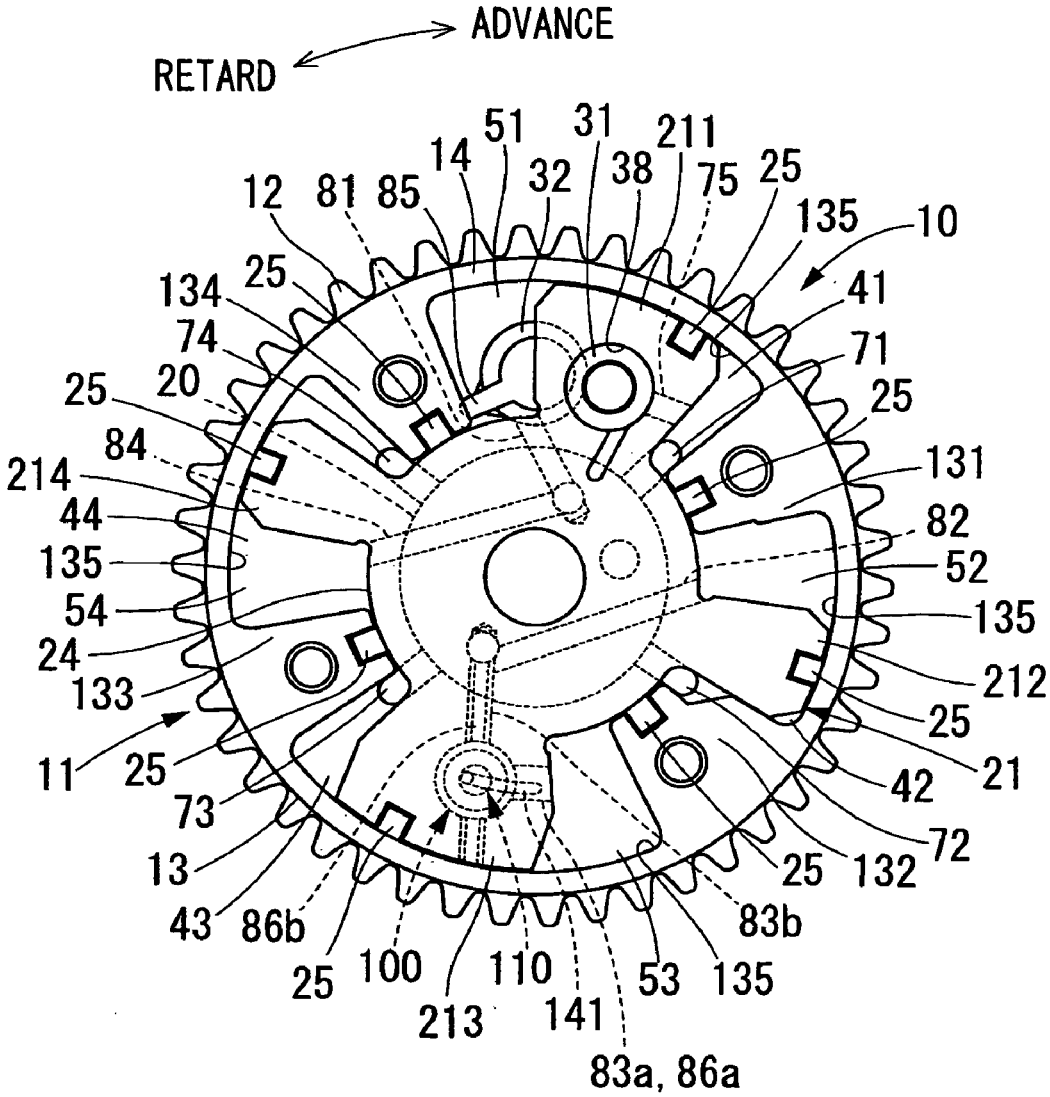
FIG. 9 is a cross sectional view showing a valve timing adjusting apparatus according to a third embodiment.
Figure 10:
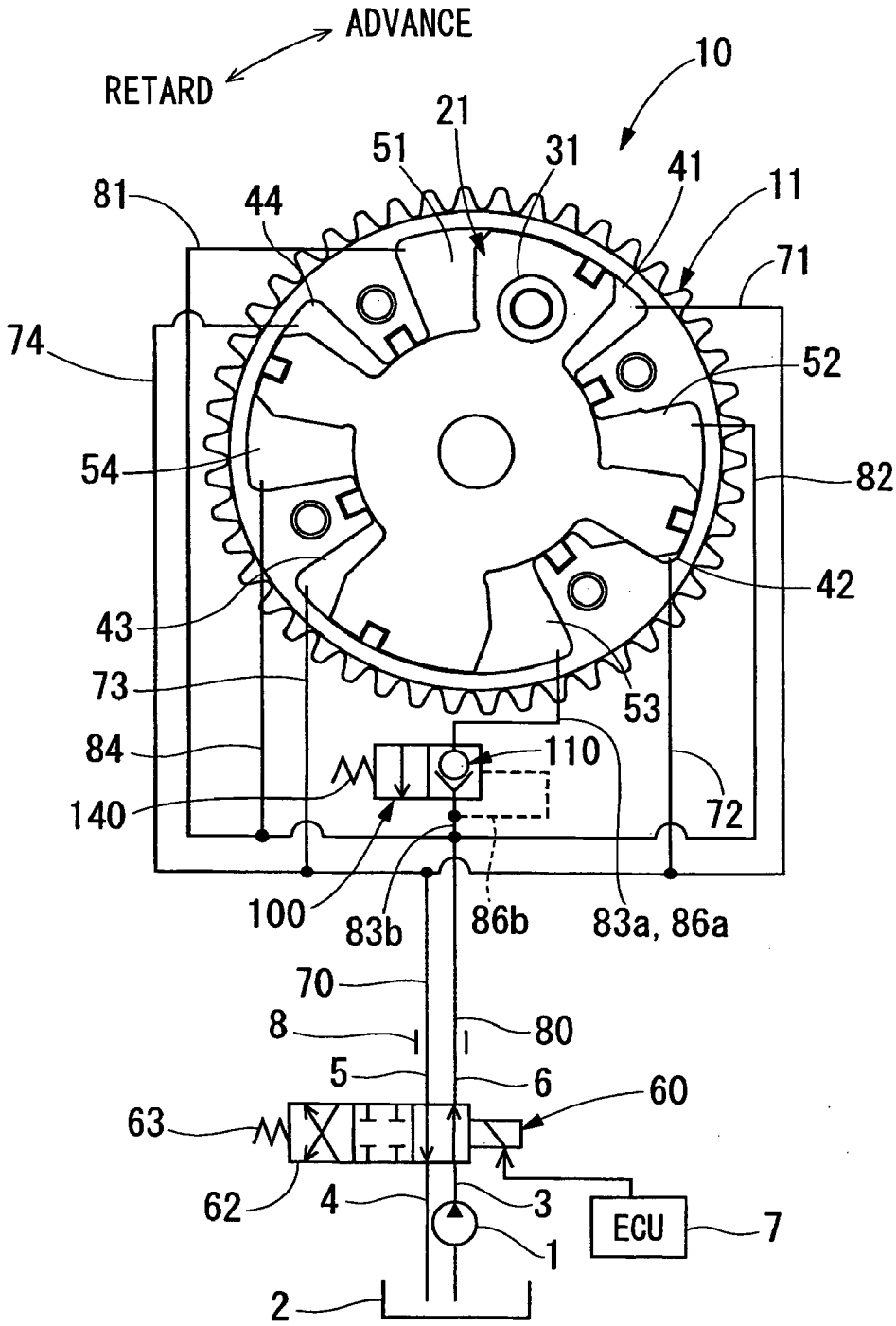
FIG. 10 is a schematic view of the apparatus according to the third embodiment, showing one of operational positions.
Figure 11:
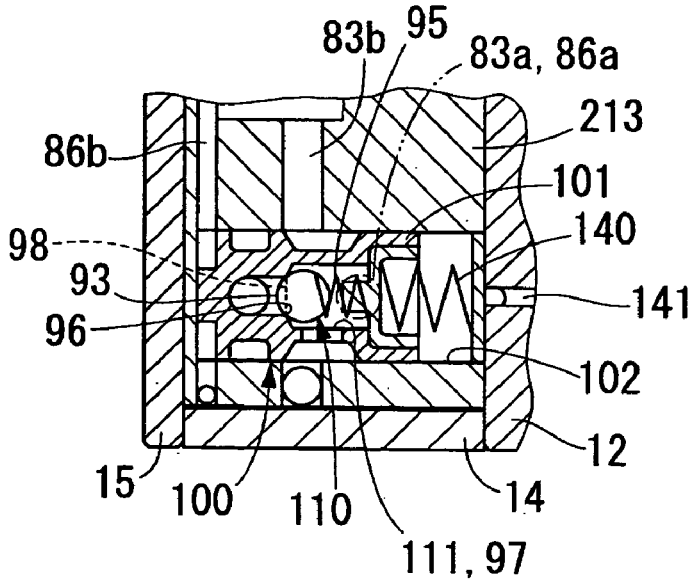
FIG. 11 is a cross sectional view, showing a major portion (a control valve) of the apparatus according to the third embodiment.

A valve timing adjusting apparatus 10 according to a third embodiment of the present invention is shown in FIGS. 9 to 11, which is a modification of the second embodiment. The same reference numerals are used here to designate the same or substantially the same parts of the second embodiment.

According to the valve timing adjusting apparatus 10 of the third embodiment, a passage corresponding to the retarding bypass passage 76 is not provided. Instead, an elastic member 140 and a back-pressure releasing port 141 are provided. More exactly, the elastic member 140 is made of a spring, which is accommodated in the spool hole 102. The elastic member 140 biases the spool 101 toward the front plate 15 by the restoring force of the spring 140. The back-pressure releasing port 141 is formed in the sprocket 12, wherein the port 141 penetrates the sprocket 12 and connected at one end with the spool hole 101. The other end of the port 141 is opened to the atmosphere.

According to the third embodiment of the above structure, the same operation of the control valve 100 to the second embodiment is achieved in the third embodiment, in which the restoring force of the elastic member 140 is applied to the spool 101 in place of the fluid pressure from the retarding bypass passage 76. Accordingly, the generation of the slapping sound is sufficiently suppressed and the response for the advancing operation can be improved.

Fourth Embodiment

Figure 14:
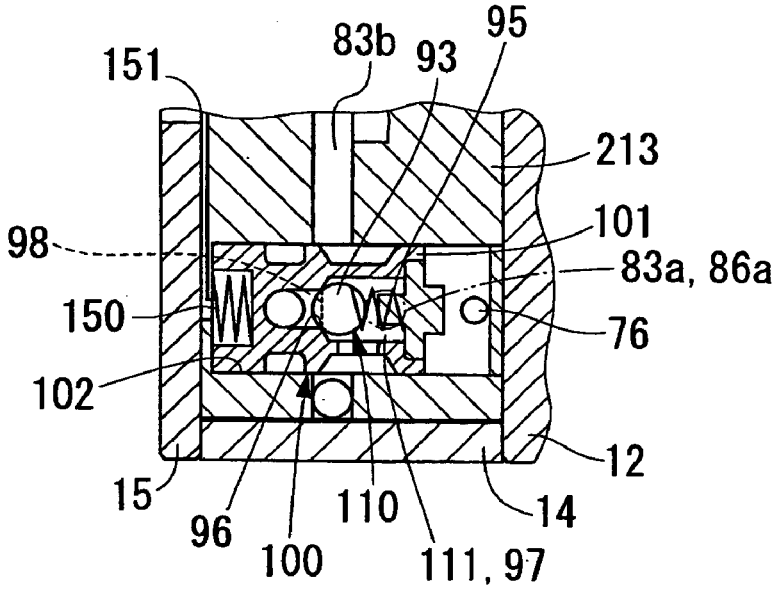
FIG. 14 is a cross sectional view, showing a major portion (a control valve) of the apparatus according to the fourth embodiment.
Figure 12:
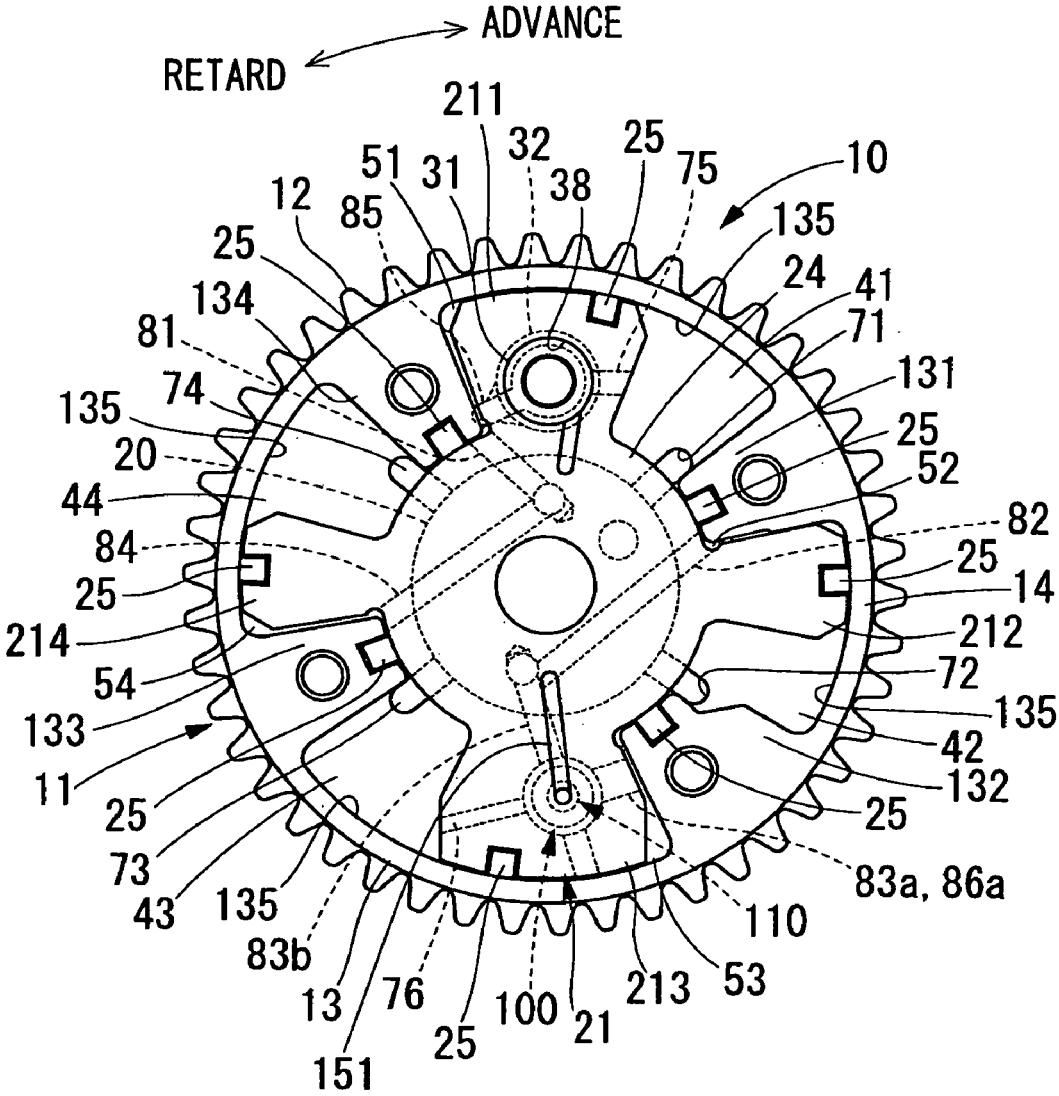
FIG. 12 is a cross sectional view showing a valve timing adjusting apparatus according to a fourth embodiment.
Figure 13:
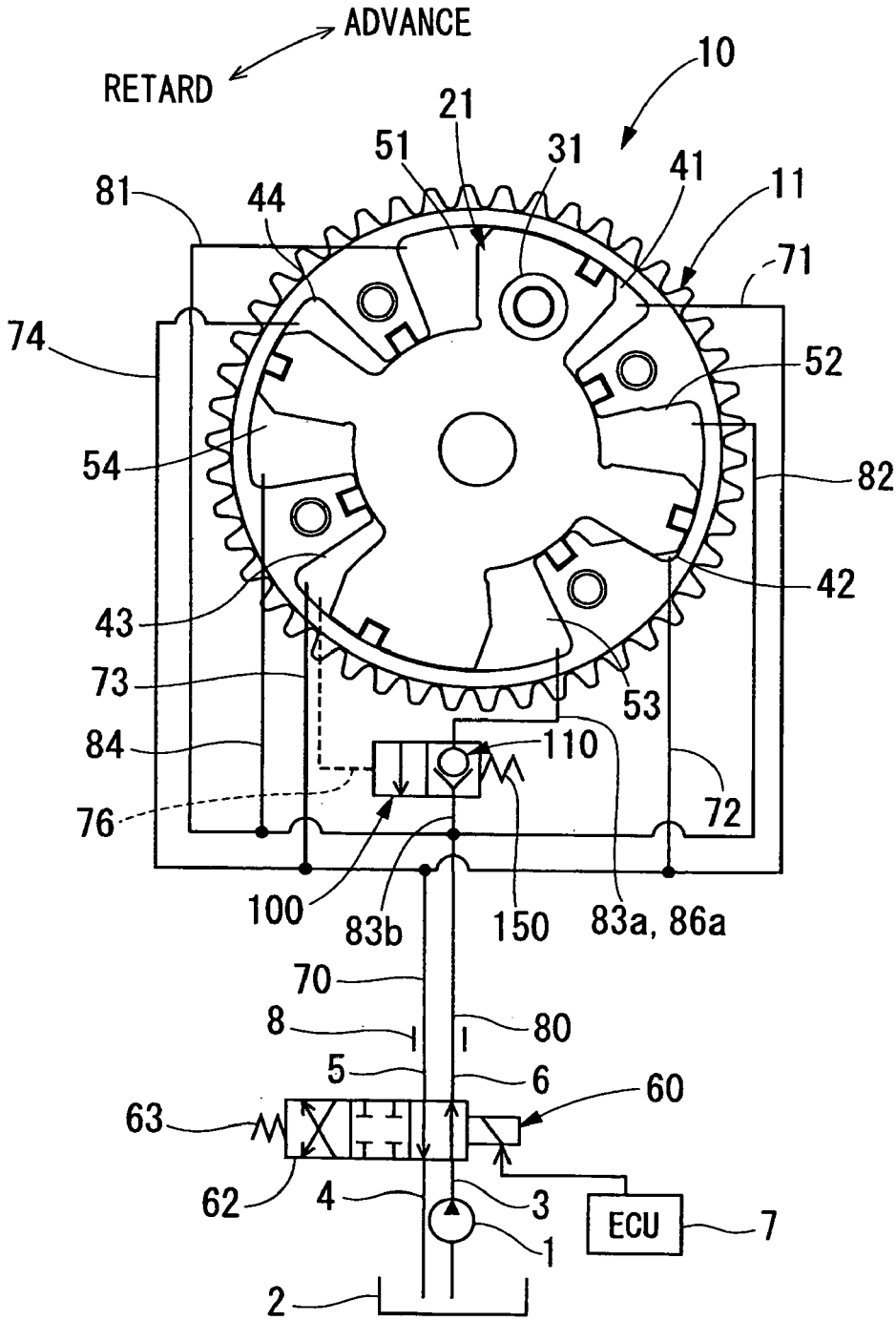
FIG. 13 is a schematic view of the apparatus according to the fourth embodiment, showing one of operational positions.

A valve timing adjusting apparatus 10 according to a fourth embodiment of the present invention is shown in FIGS. 12 to 14, which is a further modification of the second embodiment. The same reference numerals are used here to designate the same or substantially the same parts of the second embodiment.

According to the valve timing adjusting apparatus 10 of the fourth embodiment, a passage corresponding to the fourth passage portion 86*b* is not provided. Instead, an elastic member 150 and a back-pressure releasing passage 151 are provided. More exactly, the elastic member 150 is made of a spring, which is accommodated in the spool hole 102. The elastic member 150 biases the spool 101 toward the sprocket 12 by the restoring force of the spring 150. The back-pressure releasing passage 151 extends in a radial direction between the vane rotor 21 and the front plate 15 and connected to a port 151*a*, wherein the port 151*a* penetrates the front plate 15. The back-pressure releasing passage 151 is connected at one end with the spool hole 101, whereas the other end of the passage 151 is opened to the atmosphere through the port 151*a*.

According to the fourth embodiment of the above structure, the same operation of the control valve 100 to the second embodiment is achieved in the fourth embodiment, in which the restoring force of the elastic member 150 is applied to the spool 101 in place of the fluid pressure from the fourth passage portion 86*b*. Accordingly, the generation of the slapping sound is sufficiently suppressed and the response for the advancing operation can be improved.

Although the invention has been explained with respect to the embodiments, the invention is not limited to those embodiments. Instead, various kinds of modifications are possible without departing from the spirit of the invention.

For example, in the above first to fourth embodiments, the check valve 90 (or 110) and the control valve 100 may be provided in the other vane than the vane 213, or may be provided in the boss portion 24. In the first embodiment, the check valve 90 and the control valve 100 may be provided in the different vanes. In such a case, one of the check valve 90 and the control valve 100 may be provided in the vane 211, in which the stopper piston 31 is provided, or the check valve 90 and the control valve 100 may be respectively provided in the different vanes from the vane 211. Furthermore, in the above first to fourth embodiments, multiple sets of the check valve 90 (110) and the control valve 100 may be provided in the same or different vanes.

Furthermore, in the first embodiment, such an elastic member (140) and a back-pressure releasing port (141), which are similar to those in the third embodiment, may be provided instead of the retarding bypass passage 76. In addition, such an elastic member (150) and a back-pressure releasing passage (151), which are similar to those in the fourth embodiment, may be likewise provided in the first embodiment instead of the fourth passage portion 86*b*. Furthermore, in the first embodiment, the check valve 90 (110) and the control valve 100 may be respectively connected to the multiple fluid chambers between the vanes, so that the discharge of the working fluid from those fluid chambers may be controlled.

In addition, in the first embodiment, the third passage portion 86*a* of the bypass passage 86 may be connected, not directly to the advancing fluid chamber 53, but through the first passage portion 83*a* to the advancing fluid chamber 53. In such a case, miniaturization of the vane 213 becomes possible, because of the common use of the above two passage portions.

In the first, second and fourth embodiments, the retarding bypass passage 76 may be connected, not to the retarding fluid chamber 43, but to the retarding fluid path 70 or to one of the branched passage portions 71, 72, 73, and 74 branched off from the retarding fluid path 70.

In the first embodiment, the check valve 90 may be provided, not in the passage portion 83 connecting the advancing fluid path 80 with advancing fluid chamber 53, but in the passage portion 73 connecting the retarding fluid path 70 with the retarding fluid chamber 43. In such a case, the control valve may be provided, not in the bypass passage 86, but in another bypass passage connecting the retarding fluid path 70 with the retarding fluid chamber 43, wherein the other bypass passage bypasses the valve port 98 of the check valve 90 (110).

In the second to fourth embodiments, the check valve 110 as well as the control valve 100 may be provided, not in the passage portion 83 connecting the advancing fluid path 80 with the advancing fluid chamber 53, but in the passage portion 73 connecting the retarding fluid path 70 with the retarding fluid chamber 43.

In the first to fourth embodiments, the housing 11 and the cam shaft 20 may be interlocked with each other, whereas the vane rotor 21 and the crank shaft may be rotated in conjunction with each other.

The valve timing adjusting apparatus according to the first to fourth embodiments may be applied, not only to the intake valves, but also to the exhaust valves or both of the intake and exhaust valves for the engine.

What is claimed is:

1. A valve timing adjusting apparatus comprising:

a housing operatively connected to and rotated together with a crankshaft of an engine, and having multiple accommodating chambers formed in a rotational direction at predetermined angular intervals;

a vane rotor operatively connected to and rotating a cam shaft of the engine, the vane rotor having multiple vanes respectively accommodated in the accommodating chambers of the housing, each of the vanes dividing each of the accommodating chamber into a retarding fluid chamber and an advancing fluid chamber, and the vane rotor being relatively rotated by fluid pressure in the retarding fluid chamber and/or the advancing fluid chamber in a retarding or advancing direction with respect to the housing;

a retarding fluid path and an advancing fluid path respectively provided in the housing, each of which is operatively and selectively connected to a fluid pressure source;

branched passage portions provided in the housing for connecting the retarding fluid path with the retarding fluid chambers, for supplying pressurized working fluid from the fluid pressure source to the retarding fluid chambers when the retarding fluid path is connected to the fluid pressure source;

branched passage portions provided in the housing for connecting the advancing fluid path with the advancing fluid chambers for supplying pressurized working fluid from the fluid pressure source to the advancing fluid chambers when the advancing fluid path is connected to the fluid pressure source;

a lock member movably provided in the vane rotor for locking and un-locking the vane rotor to the housing, the lock member being driven to move by fluid pressure of working fluid supplied to a first fluid chamber, which is one of the retarding and advancing fluid chambers; and a check valve provided in one of the branched passage portions connected to a second fluid chamber, which is one of the retarding and advancing fluid chambers other than the first fluid chamber, wherein the check valve allows the fluid flow from the fluid pressure source to the second fluid chamber, but prohibits the fluid flow from the second fluid chamber to the fluid pressure source.

2. A valve timing adjusting apparatus according to claim 1, wherein the lock member is provided in one of the vanes, and the check valve is provided in the other vane than the above one vane.

3. A valve timing adjusting apparatus according to claim 2, wherein the other vane, in which the check valve is provided, is arranged at an opposite side of the one vane, in which the lock member is provided, with respect to a rotational center of the vane rotor.

4. A valve timing adjusting apparatus according to claim 1, wherein at least one fluid chamber is provided between the first and second fluid chambers respectively in both rotational directions.

5. A valve timing adjusting apparatus according to claim 1, wherein a bypass passage is provided between the second fluid chamber and the fluid pressure source, so that the bypass passage bypasses the check valve, and a control valve provided in the bypass passage for opening and closing the bypass passage in accordance with the fluid pressure of the working fluid introduced into the bypass passage from one of the branched passage portions.

6. A valve timing adjusting apparatus according to claim 5, wherein the control valve is provided in the vane rotor.

7. A valve timing adjusting apparatus according to claim 6, wherein the check valve and the control valve are provided in the same vane adjacent to the second fluid chamber.

8. A valve timing adjusting apparatus according to claim 1, further comprising:

a control valve having therein the check valve, wherein the control valve comprises;

a spool movably inserted into a spool hole, and having a first spool position and a second spool position, the spool being driven to move from the first to the second spool position and vice versa by the fluid pressure from one of the retarding and advancing fluid paths, wherein the second fluid chamber is communicated with the fluid pressure source when the spool is in the first spool position, in which a valve port of the check valve is bypassed, and the second fluid chamber is communicated with the fluid pressure source when the spool is in the second spool position, through the valve port of the check valve.

9. A valve timing adjusting apparatus for an engine having intake and exhaust valves comprising:

a driving-side unit connected to a crankshaft of the engine and a driven-side unit connected to a cam shaft of the engine, a driving power of the engine being transmitted from the driving-side unit to the driven-side unit such that a relative rotational position of the driven-side unit to the driving-side unit is adjusted;

a housing formed in one of the driving-side and driven-side units, and having multiple accommodating chambers formed in a rotational direction at predetermined angular intervals;

a vane rotor formed in the other of the driving-side and driven-side units, the vane rotor having multiple vanes respectively accommodated in the accommodating chambers of the housing, each of the vanes dividing each of the accommodating chamber into a retarding fluid chamber and an advancing fluid chamber, and the vane rotor being relatively rotated by fluid pressure in the retarding fluid chamber and/or the advancing fluid chamber in a retarding or advancing direction with respect to the housing;

a retarding fluid path and an advancing fluid path respectively provided in the housing, each of which is operatively and selectively connected to a fluid pressure source;

branched passage portions provided in the housing for connecting the retarding fluid path with the retarding fluid chambers, for supplying pressurized working fluid from the fluid pressure source to the retarding fluid chambers when the retarding fluid path is connected to the fluid pressure source;

branched passage portions provided in the housing for connecting the advancing fluid path with the advancing fluid chambers for supplying pressurized working fluid from the fluid pressure source to the advancing fluid chambers when the advancing fluid path is connected to the fluid pressure source;

a lock member movably provided in the vane rotor for locking and un-locking the vane rotor to the housing, the lock member being driven to move by fluid pressure of working fluid supplied to a first fluid chamber, which is one of the retarding and advancing fluid chambers; and a check valve provided in one of the branched passage portions connected to a second fluid chamber, which is one of the retarding and advancing fluid chambers other than the first fluid chamber, wherein the check valve allows the fluid flow from the fluid pressure source to the second fluid chamber, but prohibits the fluid flow from the second fluid chamber to the fluid pressure source.

* * * * *